United States Patent [19]

Weigl

[11] 3,953,206

[45] Apr. 27, 1976

[54] INDUCTION IMAGING METHOD UTILIZING AN IMAGING MEMBER WITH AN INSULATING LAYER OVER A PHOTOCONDUCTIVE LAYER

[75] Inventor: John W. Weigl, West Webster, N.Y.

[73] Assignee: Xerox Corporation, Stamford, Conn.

[22] Filed: Apr. 30, 1974

[21] Appl. No.: 465,457

[52] U.S. Cl. ..... 96/1 LY; 96/1 R; 96/1.5

[51] Int. Cl.[2] ..... G03G 13/10

[58] Field of Search ..... 96/1 LY, 1.5, 1 SD, 96/1 R

[56] References Cited

UNITED STATES PATENTS

| | | | |
|---|---|---|---|
| 3,084,043 | 4/1963 | Gundlach | 96/1 LY |
| 3,677,751 | 7/1972 | Wasaburo et al. | 96/1 R |
| 3,704,121 | 11/1972 | Makino et al. | 96/1 R |
| 3,813,243 | 5/1974 | Kitajima et al. | 96/1.5 |
| 3,837,853 | 9/1974 | Masaki et al. | 96/1.5 |
| 3,843,361 | 10/1974 | Gaynor | 96/1 R |
| 3,843,381 | 10/1974 | Matsumoto et al. | 96/1 SD |

*Primary Examiner*—David Klein
*Assistant Examiner*—Judson R. Hightower
*Attorney, Agent, or Firm*—James J. Ralabate; James P. O'Sullivan; John H. Faro

[57] ABSTRACT

An induction imaging process wherein the electrophotographic imaging member comprises at least three separate and distinct layers; namely, a conductive substrate, a photoconductive insulating layer and an insulating film overcoating the free surface of the photoconductive insulating layer. This process provides an efficient route for latent image formation, development and erasure of charge carriers trapped at the interface of the insulating overcoating and the layer contiguous with said coating. This process is especially suitable for use in combination with polar liquid development.

29 Claims, 6 Drawing Figures

FIG. 1(b) FIG. 1(c)

S | L
DEVELOPMENT
SEPERATION OF
DEVELOPMENT ELECTRODE
AND IMAGING
REMOVAL OF
DEVELOPER
ELECTRODE
TRANSFER OF
DEVELOPER MAT'LS
TO RECIEVING
SHEET
REMOVAL OF
DEVELOPER
RESIDUES
REDEVELOP
AS
ABOVE

INDUCTION IMAGING METHOD UTILIZING AN IMAGING MEMBER WITH AN INSULATING LAYER OVER A PHOTOCONDUCTIVE LAYER

BACKGROUND OF THE INVENTION

1. Field of the Invention

This invention relates to an imaging process. More specifically, this invention concerns an improved induction imaging process that is highly compatible with polar liquid development.

2. Description of the Prior Art

The formation and development of images on an imaging layer of photoconductive materials by electrostatic means is well known. The best known of the commercial processes, more commonly known as xerography, involves forming a latent electrostatic image on the imaging layer of an imaging member by first uniformly electrostatically charging the surface of the imaging layer in the dark and then exposing this electrostatically charged surface to a light and shadow image. The light struck areas of the imaging layer are thus rendered relatively conductive and the electrostatic charge selectively dissipated in these irradiated areas. After the photoconductor is exposed, the latent electrostatic image on this image bearing surface is rendered visible by development with charged finely-divided colored electroscopic powder material known in the art as "toner". This toner will be principally attracted to those areas on the image bearing surface having a polarity opposite to the change on said toner particles and thus form a visible powder image.

The development image can be read or permanently affixed to the photoconductor in the event the imaging layer is not to be reused. This latter practice is usually followed with respect to binder type photoconductive films where the photoconductive insulating layer is also an integral part of the finished copy, e.g. U.S. Pat. Nos. 3,121,006 and 3,121,007.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor it is subsequently transferred to another substrate and then permanently affixed thereto. Any one of a variety of well known techniques can be used to permanently affix the toner image to the transfer sheet, including overcoating with transparent films and solvent or thermal fusion of the toner particles to the support of the substrate.

In the most popular of the xerographic systems of the type referred to above, the imaging member comprises a photoconductive insulating layer or amorphous selenium on a suitable conductive substrate. Due to problems inherent in preparation of such imaging members, and the increasing cost of materials used in said members, a number of alternative photoconductive imaging members have been proposed which eliminate such fabrication problems and reduce the amount of photoconductive materials, such as amorphous selenium, required by these members. In one such alternative photoconductor system, a photogenerator layer of amorphous selenium is laminated to a charge carrier transport layer of poly(N-vinylcarbazole), U.K. Pat. No. 1,337,228. The relative arrangement of selenium to poly(N-vinylcarbazole) vis-a-vis the conductive substrate is variable and determinative of the mode of sensitization of this member. However, since the relatively thin photogenerator layer of amorphous selenium is highly sensitive to abrasion it must be protected from the physical abuses occasioned during development and cleaning in order to insure reasonable photoreceptor life. It is thus preferred that the photogenerator layer be formed directly on the substrate and thereafter overcoated with the charge carrier transport layer. Although the materials proposed for use in such transport layers do have the ability to withstand greater abuse than the photogenerator layer due to their increased thickness and other inherent mechanical properties, the materials which have been proposed heretofore as suitable transport layers are highly sensitive to mechanical abrasion and damage, particularly under development conditions in which a development electrode is firmly pressed against the charged and imaged photoreceptor, and well as under cleaning conditions where a cleaning member may be scraped over the surface of the photoreceptor subsequent to image transfer. Such abrasion is almost unavoidable in an otherwise simple and efficient development process called polar liquid development, which is described in Gundlach U.S. Pat. No. 3,084,043. In this process, a polar developer or "ink" may be presented to the electrostatic latent image, e.g. by pressure contact with a serrated metal roller, such as a trihelicoid gravure coating roller. After image development and transfer, residual ink may be scraped off the photoreceptor surface by an absorbent sponge or web or by absorption in powder followed by web cleaning. For the photoreceptor to have mechanical durability under these conditions, and to protect the active photoconductive layer or layers against chemical damage due to corona ions, oxygen, and toner residues, it is highly advantageous to use a photoreceptor structure having a relatively tough abrasion-resistant protective surface layer comprising a dielectric polymer substantially devoid of photosensitivity to light in the visible and near ultraviolet region of the electromagnetic spectrum.

Surface protected photoreceptors having a dielectric overcoating with a dielectric thickness comparable to that of the photoreceptor layer have been used previously, as described by Hall (U.S. Pat. No. 3,234,019), by Mitsui (IEEE Trans. on Elect. Devices, vol. ED 19 No. 4, 1972 pp 396 – 404) and by Nakamura (ibid. pp. 405 – 412). The processes described for the use of such photoreceptors, however, are complex and restrictive, requiring multiple charging and illumination steps, and forcing the user to restrict the imaging process to either a negative-to-positive mode or to carry out image exposure during simultaneous corona charging. The latter restriction makes it impractical, for example, to make full frame or full frame flash exposures and thus restricts imaging, in effect, to the relatively inefficient slit-scan mode. As is well known, slit scanning is very wasteful of radiant energy. Given the limitations of photosensitivity of known photoreceptor materials, it has been impossible heretofore to produce a photoreceptor suitable for fast cyclic xerographic duplicating using full frame exposure in the positive-to-positive mode, with a photoreceptor having a thick, durable, and flexible protective plastic overcoating.

Accordingly, it is the object of this invention to remove the above as well as related deficiencies in the prior art.

More specifically, it is an object of this invention to provide an overcoated imaging member suitable for use in an induction imaging process which also has resistance to abrasion and oxidation.

It is another object of this invention to provide an induction imaging process compatible with the use of full frame exposure.

It is yet another object of this invention to provide an induction imaging process capable of preparation of multiple copies from a single image exposure.

It is another of the objects of this invention to provide an induction imaging process wherein the photoconductive insulating layer utilized in said process consists essentially of two distinct and separate phases; namely, a charge carrier generator layer and a charge carrier transport layer.

It is yet another object of this invention to provide an induction imaging process which is compatible with polar liquid development.

It is yet a further object of this invention to provide an induction type imaging process capable of rapid and repeated cycling.

SUMMARY OF THE INVENTION

The above and related objects are achieved by providing an imaging process which utilizes a dielectric overcoated imaging member. In this process an imaging member comprising a conductive substrate, a photoconductive insulating structure (comprising one or two layers) and an insulating overcoating is sensitized to the appropriate polarity and thereafter exposed to a light and shadow image pattern. In the illuminated regions of the imaging member charge carriers are injected and transported from the photoactivated light-absorbing regions of the imaging member to the interface of the photoconductive insulating layer and insulating overcoating where they are trapped and thereby immobilized. In the non-illuminated areas of the imaging member, the countercharge at the interface of the photoconductive insulating layer and conductive substrate retains its mobility and can be shunted from this interface into a developer laden electrode disposed adjacent to the sensitized surface of the insulating film overcoating said member. Upon separation of this developer laden electrode and the imaging member, the charge on the surface of the insulating film corresponding to the shadow areas of the image pattern will be shunted from the development electrode back into the base electrode. Separation of this electrode from the grounded imaging member shifts the image pattern in the dark areas but not in the previously illuminated areas. Thus, mobile charge carriers are shunted back and forth between the base electrode and the developer laden electrode, thereby converting the latent image, formed as a result of a shift in capacitance across the layers of the imaging member, to one which induces selective transfer of developer materials to the surface of dielectric overcoating from the developer laden electrode.

DESCRIPTION OF THE INVENTION INCLUDING PREFERRED EMBODIMENTS

The photoconductive imaging member useful in this invention can be prepared by forming a series of individual layers, in sequence, on an appropriately prepared conductive substrate.

The conductive substrates which are used in these imaging members can be selected from any of the materials commonly used in preparation of electrophotographic imaging members. Typical of the materials suitable for use in such substrates include aluminum, chromium, brass, stainless steel, the respective alloys of said materials, metalized plastic films, metal coated plastic films and glass plates having semi-conductive oxide coatings (e.g. NESA glass — available from PPG Industries). Where appropriate, the conductive substrate can be pretreated or coated with a relatively thin barrier layer ($\sim<1$ $\mu m$) of insulating material. The purpose of such pretreatment or coating is to provide a blocking contact between the substrate and the photoconductive insulating layer.

This photoconductive insulating layer can be essentially free of binders (e.g. amorphous selenium); contain photoconductive pigments randomly dispersed throughout an insulating binder resin; contain spatially oriented photoconductive pigments in an insulating binder (e.g. U.S. Pat. No. 3,787,208); or have a plurality of individual layers, each being capable of performing a separate function (e.g. U.K. Pat. No. 1,337,228 and Canadian Pat. No. 932,199).

In the latter case, the photoconductive insulating layer can consist essentially of two distinct and separate layers, a charge carrier generating layer and a charge carrier transport layer. Typically, the ratio of thickness of the charge carrier generating layer to charge carrier transport layer can range from about 1:200 to about 1:1.

Figure 2:
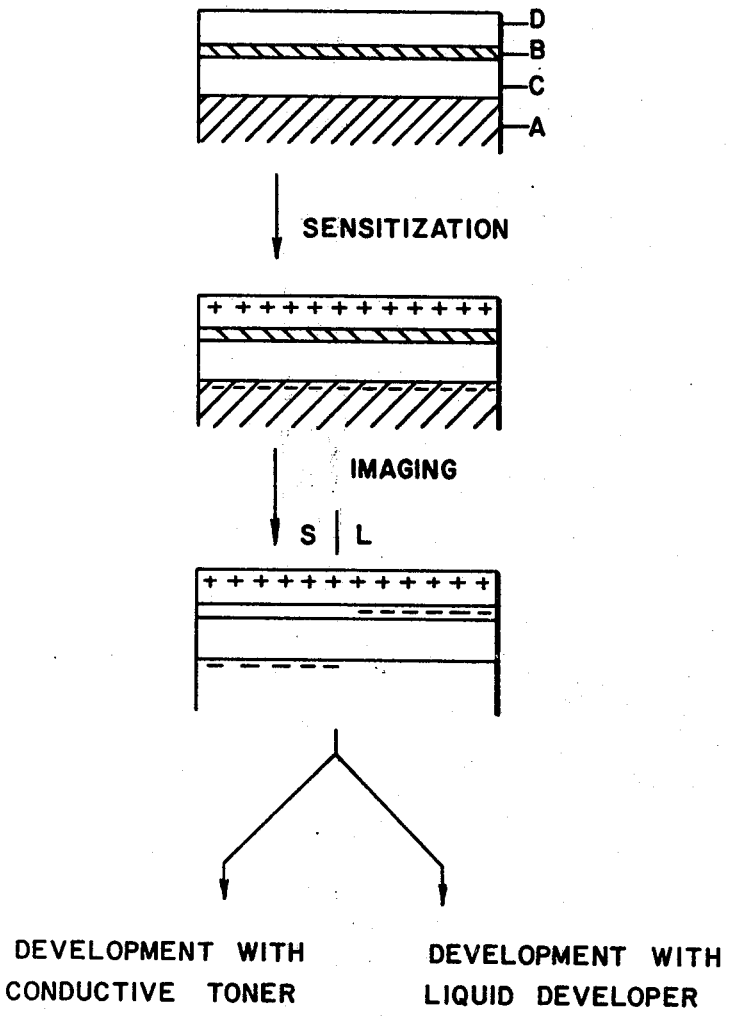

Although it is possible that this composite layer may be preformed on an insulating film and thereafter laminated to the substrate, it is generally preferred that the individual layers of the composite photoconductive insulating layer be formed independently of one another in sequence on the substrate. The relative order in which such layers are formed on the conductive substrate determines whether or not a separately formed barrier layer is required and is also determinative of the polarity of the sensitizing charge used in latent image formation. In a preferred embodiment of this invention wherein the photoconductive insulating layer consists essentially of a photogenerator layer of amorphous selenium and a charged carrier transport layer of poly(N-vinylcarbazole), the formation of the charge carrier transport layer contiguous with the conductive substrate will generally avoid the necessity of providing a separate blocking contact between the conductive substrate and the composite photoconductive insulating layer since the poly(N-vinylcarbazole) layer effectively precludes injection of electrons into the composite photoconductive insulating layer. FIG. 2 is illustrative of this embodiment of the invention. The relative thickness of the layers used in the composite photoconductive insulating layer can vary within previously defined limits and the various combinations of materials disclosed in the prior art (see for example previously referenced U.K. Pat. No. 1,337,228 and Canadian Pat. No. 932,199).

Upon completion of formation of the photoconductive insulating layer on the conductive substrate, the free surface of this layer is overcoated with an insulating film. This overcoating is characterized as substantially incapable of supporting injection or transport of charge carriers of either polarity and substantially non-absorbing of electromagnetic radiation within the wavelength of spectral response of the photoconductive insulating layer. The thickness of this overcoating is based upon the relative thickness of the photoconductive insulating layer. It is generally advisable that the dielectric thickness (dielectric thickness being defined as the geometrical thickness/dielectric constant) of the insulating overcoating relative to the photoconductive insulating layer be in the range of from about 0.1:1 to about 10:1 and preferably from about 0.5:1 to about 2:1. Materials which are suitable for use as the insulating overcoating of the imaging member of this invention include, for example, polycarbonates, polyethylene, polyethylene terephthalate, polyesters, polyvinylfloride, poly(styrene-co-butadiene), silicone elastomers and melamine, phenoxy, epoxy or acrylic resins.

Figures 1, 1A, 1B, 1C:
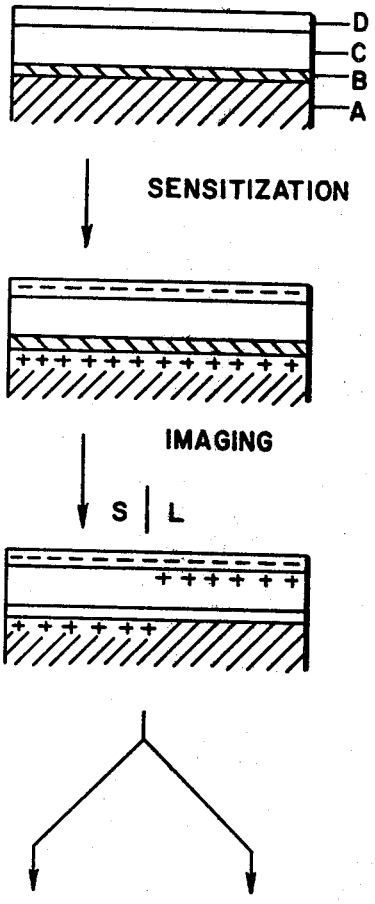
FIG. 1 – 4 are illustrative of the various modifications of the imaging processes of this invention.
Figures 1B, 1C:
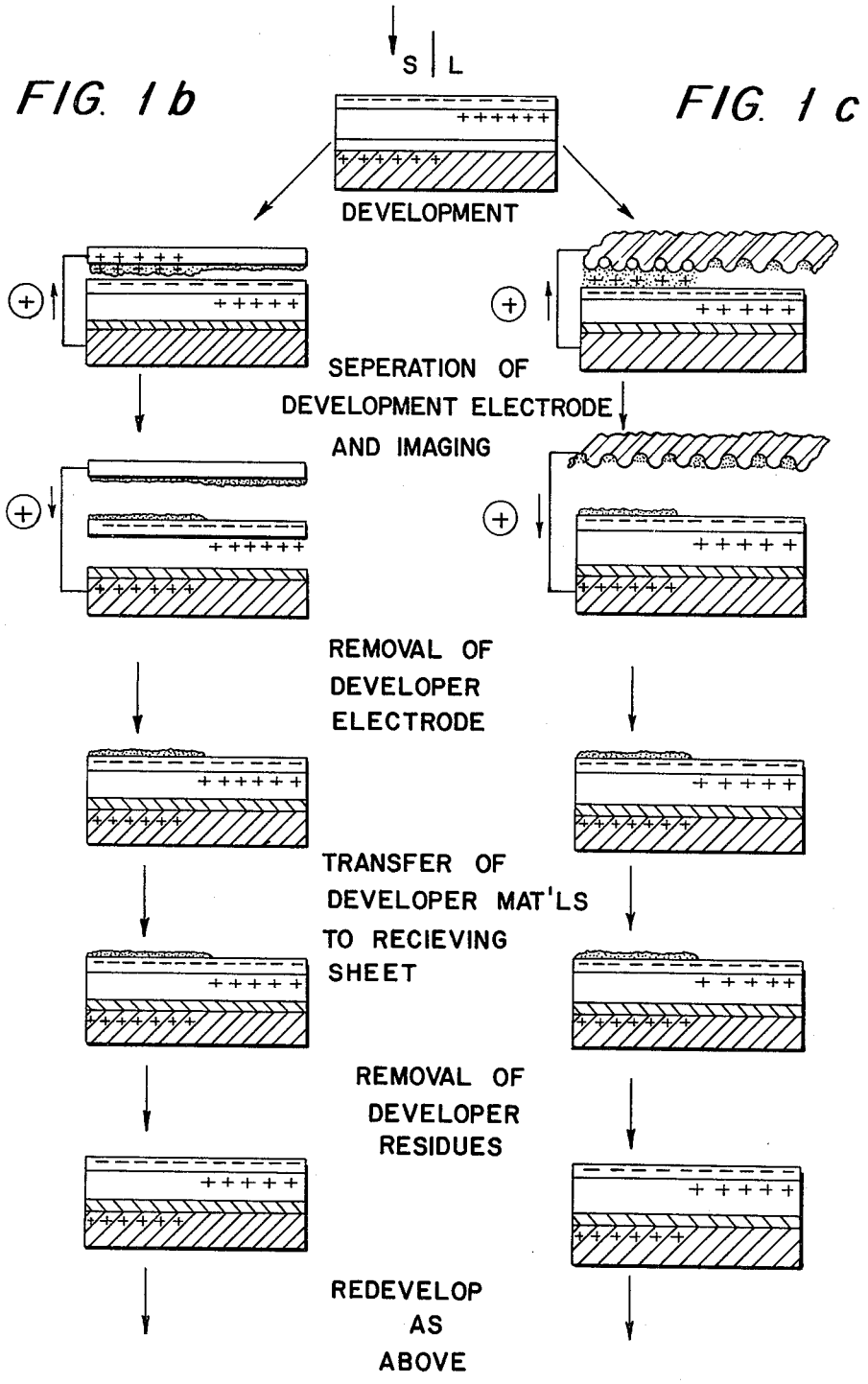

Once having prepared an imaging member in the manner and from the materials described above, it is suitable for use in an induction type imaging system. Representative imaging systems of this invention are illustrated by FIGS. 1 and 2. In FIG. 1, the imaging member comprises a conductive substrate (layer A), a charge carrier generating layer of amorphous selenium approximately 0.5 microns in thickness (layer B), a charge carrier transport layer of poly(N-vinylcarbazole) having a film thickness of approximately 25 microns (layer C) and an insulating overcoating of polyethylene terephthalate having a film thickness of about 12 microns (layer D). In FIG. 2 the relative arrangement of layers B and C is reversed. The relative arrangement of the layers within the photoconductive composite layer dictates the polarity of charge imparted to the surface of layer D in the sensitization of the imaging member. For example, the polarity of the sensitizing charge for the structure of FIG. 2 should be the same as the polarity of majority carrier transport capability of layer C, whereas, such sensitizing charge should be the reverse of the majority carrier transport capability of layer C for the structure of FIG. 1. Upon imagewise illumination of the imaging member with electromagnetic radiation which is strongly absorbed by carrier generating layer B, hole-electron pairs are generated within layer B. Positive charge carriers are injected and transported from this carrier generator layer B across hole transport layer C to the interface of layers C and D. Electrons generated within layer B during photoexcitation inject into the conductive substrate and thus neutralize the positive charge at the interface of layers A and B. During imagewise exposure of the imaging member of the type shown in FIG. 2, positive charge carriers generated within layer B are injected and transported through layer C to the interface of the photoconductive insulating layer and the conductive substrate. Electrons generated within layer B are trapped at the interface of layer B and layer D. In each case, once the carriers are trapped at the interface of the dielectric layer and the layer contiguous therewith, they are immobilized and remain so during the development sequence. However, in the shadow areas, the carriers retain their mobility; moving freely between the conductive substrate of the imaging member and the development electrode once the latter is disposed opposite the surface of the dielectric layer (FIGS. 1 (*b*) and 1 (*c*)). Upon disengagement of the development electrode and the imaging member, and after selective deposition of developer material on the dielectric layer in those areas corresponding to the shadow portions of the image, the mobile carriers within said development electrode (corresponding to the shadow areas of the image pattern) are returned to the conductive substrate of the imaging member.

In one of the preferred embodiments of this invention, the development electrode can comprise a gravure roller which has been previously inked with a polar liquid developer solution or dispersion. The term "polar liquid developers" defines liquid developers into which charge can be induced from a conductive applicator, and which are capable of moving in an electric field without substantial electrophoretic segregation of their components. Typical polar liquid developers are disclosed in U.S. Pat. No. 3,084,043 to Gundlach; U.S. Pat. No. 3,725,059 to Komp; U.S. Pat. No. 3,748,127 to Amidon et al; and U.S. Pat. No. 3,736,133 to Weigl et al. They may be pigmented or dyed, and they may have resistivities, between $10^4$ – $10^{14}$ ohm-cm, preferably between $10^9$ – $10^{12}$ ohm-cm.

As mobile charge carriers are shunted from the interface of the conductive substrate into the gravure roller, the polar ink contained within the valleys of said roller will assume the same charge and thus be selectively attracted to those areas on the surface of the dielectric layer corresponding to dark (unexposed) areas of the image. This developer image may thereafter be transferred to an absorbent sheet, such as paper and the copying cycle repeated. The latent image pattern can be developed repeatedly until such time as the sensitizing charge on the surface of the dielectric layer is dissipated.

In order to prepare the imaging member for the reproduction of a new and different image, the charge trapped at the interface of the insulating overcoating and the photoconductive composite layer must be dissipated. This is achieved by simple blanket exposure of the imaging member to activating radiation simultaneous with charging of the surface of the insulating overcoating to a neutral potential. The activating radiation serves to photoexcite carriers close to the interface of dielectric layer D and to neutralize the charge trapped there during imagewise exposure, while compensating charge is drawn across the composite photoconductive insulating layer to the conductive substrate.

Two of the photoreceptors described hereinabove are unique in that they combine an inert dielectric overcoating and a two layer "active matrix" imaging. The active matrix type concept as applied to a two layered composite photoconductive insulating structure, involves the separation of carrier generation and transport functions between the individual layers; e.g. mobile charge carriers being produced in response to activating electromagnetic radiation in a photogenerator layer and transport of injected charge carriers of at least one polarity by the transport layer. The basic structure of such double layer photoreceptors are described in U.S. Pat. No. 3,573,906 — to Goffe; U.K. Pat. No. 1,337,228 (previously referenced) — to Smith et al; and Canadian Pat. No. 932,199 — to Regensburger. The addition of a dielectric overcoating makes such photoreceptors useful in long term cycling use with polar liquid or conductive dry toner developers applied by means of development electrodes in contact with the photoreceptor surface. In addition, it also enables one to use such photoreceptors to make multiple images from a single image exposure, by a unique imaging process as specified hereinabove.

The Examples which follow further define, describe and illustrate the imaging processes of this invention. Apparatus and techniques used in preparation of the imaging members useful in this process as well as the apparatus and techniques used in carrying out this process are standard in the electrophotographic arts or as hereinbefore described. Parts and percentages appearing in such Examples are by weight unless otherwise indicated.

EXAMPLE I

An electrophotographic imaging member corresponding to the structure shown in FIG. 1 is prepared by a procedure analogous to that described by Gundlach in U.S. Pat. No. 3,251,686.

A 12.5 $\mu m$ film of "subbed" polyethylene terephthalate ("Cronar" - available from E. I. du Pont de Nemours and Co., Wilimington, Delaware) is draw coated with a 10 percent solution of poly(N-vinylcarbazole) ("Luvican" - available from BASF — $\overline{M}_w \pm 200,000$) in tetrahydrofuran by means of a Gardner mechanical drive apparatus equipped with a doctor blade having a wet gap setting of 0.008 inches. The polymer film is allowed to dry, and the coated Mylar inserted into a vacuum evaporation chamber and a thin film (0.5 $\mu m$) of amorphous selenium is deposited on the surface of the carbazole film. This composite is transferred to a second evaporator and a thin film of aluminum vacuum coated over the selenium layer. This aluminum coating serves to insure excellent electrical contact between the above laminate and a yet to be bonded supportive substrate. The structure is now superimposed on a 2 mil thick Mylar plastic sheet coated with a 5 $\mu m$ dry film comprising a dispersion of conductive carbon black and 65 percent sucrose acetate — isobutyrate, Columbian Carbon Co.). These two films are bonded to one another by contacting the aluminum coated side of the laminate with thermoplastic coated surface of supportive member followed by heating this incompletely joined structure sufficiently to melt the conductive thermoplastic binder on the supportive substrate. The composite is then cooled and its electrophotographic properties evaluated. Effective ground contact is established by a wire which has been inserted between the polylaminate and the supportive substrate prior to their lamination.

The imaging member prepared as described above, is sensitized to a negative potential of about 600 volts, exposed to a light and shadow image pattern and contacted with a biased gravure roller laden with a polar ink of the following composition.

*Light Mineral Oil* — 30 parts by weight

*Ganex V* — 216 (an alkylated polyvinylpyrrolidone — available from GAF Corporation) 15 parts by weight

*Microlith* — C. T. Black (a resinated carbon black pigment composed of about 40 percent carbon black and 60 percent ester gum resin — available from CIBA Corporation) — 18 parts by weight

*V. M.* — 550 methyl violet tannate flushed pigment (available from Magruder Color Company) 3 parts by weight

*Paraflint* — R. G. Wax (a hydrocarbon wax available from Moor and Munger Corp.) 0.5 parts by weight The developed image is transferred to an absorbent receiving sheet (Xerox 4024 bond paper); residual ink is removed from the photoreceptor surface with a soft cotton cloth; and the surface of the photoreceptor is exposed to blanket illumination with ultraviolet light simultaneous with scorotron charging to a neutral potential. The images thus produced are of good quality and such quality is readily reproducible.

EXAMPLE II

The procedures of Example I are repeated with an electrophotographic imaging member corresponding to the structure shown in FIG. 2. This imaging member is prepared in substantially the same manner as described in Example I except for a reversal in the order of coating the respective layers of the photoconductive composite on the dielectric layer. Because of reversal in the order of the separate layers of the photoconductive composite and the characteristic hole transport properties of layer C, the surface of said member is sensitized by positive charging. Copy quality and cycling of the imaging member are equivalent to that achieved in Example I.

EXAMPLE III

Figure 3:
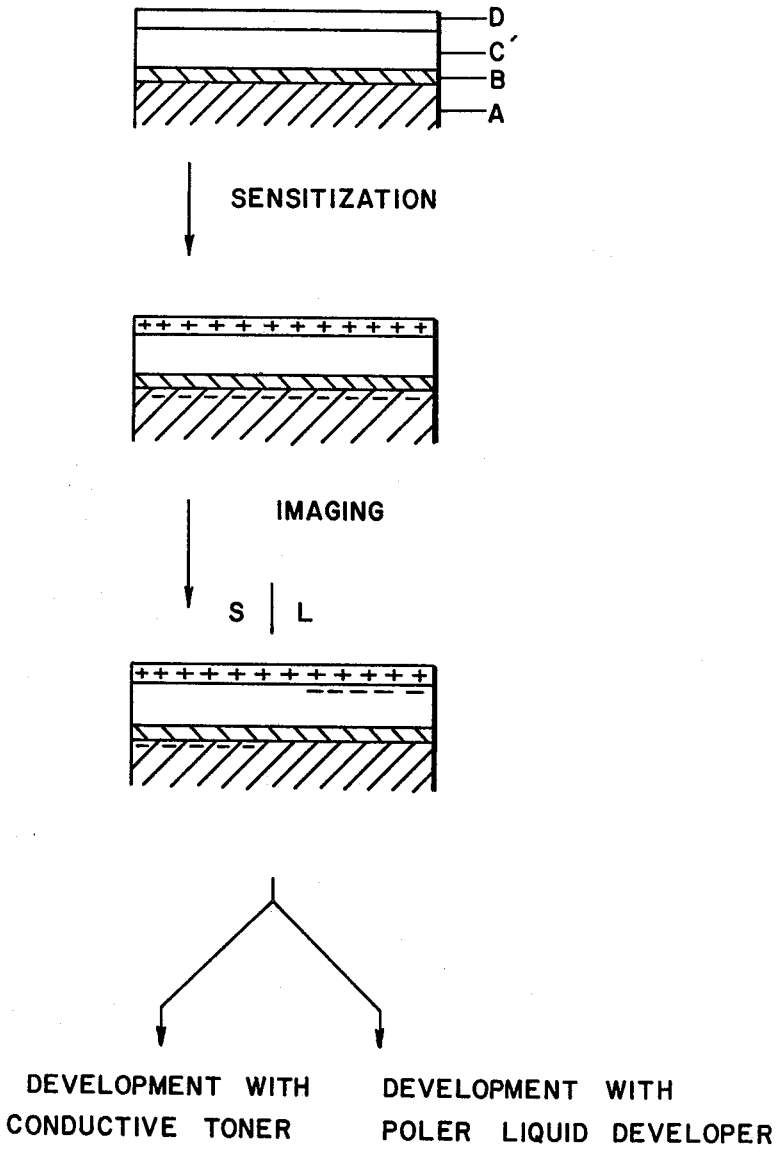

An electrophotographic member corresponding to the structure shown in FIG. 3 is prepared in the same manner as described in Example I except that layer C′ comprises a 15 $\mu m$ layer of 2,4,7-trinitro-9-fluorenone. This component of the photoconductive composite is formed on the dielectric film by well-known vacuum evaporation techniques (see for example, Canadian Pat. No. 932,199 — Example I). The surface of the dielectric film of the imaging member is sensitized in the conventional manner, however, since the electronic properties layer C′ favors electron transport and layer C′ is contiguous with the dielectric film, the polarity of the sensitizing charge must be positive.

EXAMPLE IV

Figure 4:
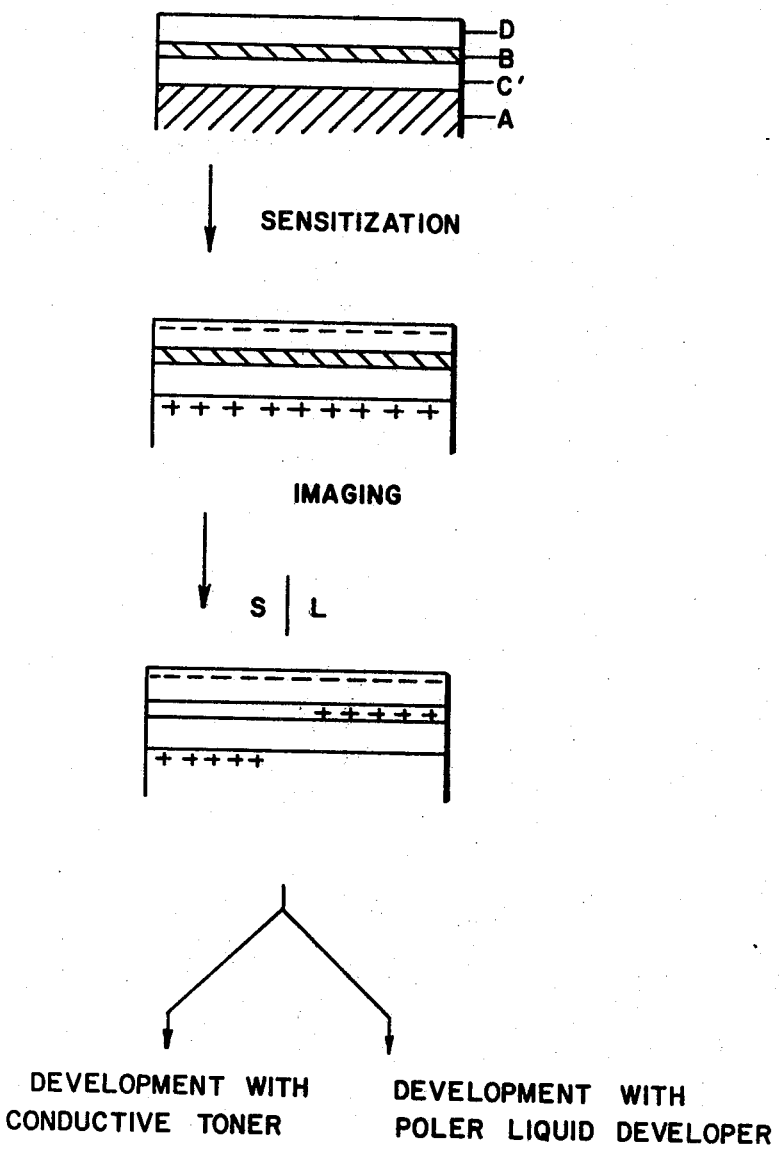

The procedures of Example III are repeated with an electrophotographic imaging member corresponding to the structure shown in FIG. 4. This imaging member is prepared in substantially the same manner as described in Example III, except for a reversal in the relative order of layers B and C′. The surface of the dielectric layer is sensitized in the conventional manner, however, because of the reversal in relative arrangements of layer B and C′, the polarity of the sensitizing charge must be negative. Copy quality and cycling are equivalent to that achieved in Example I.

EXAMPLE V

A 4 inch × 5 inch unitary photoconductor layer, 55 $\mu m$ thick and consisting of 90 parts (by volume) of Flexclad PE3177A Goodyear preparation polyester resin and 10 parts of photoconductive cadmium sulfoselenide pigment ($CdS_{0.6}Se_{0.4}$) is prepared on a tin oxide coated glass plate (NESA, PPG Industries) according to example 14 of U.S. Pat. No. 3,787,208 (which is hereby incorporated by reference). A 2 $\mu m$ (dry thickness) layer of polyester adhesive (du Pont resin 49000) is spray coated onto a sheet of 1 mil du Pont Mylar polyester film. The Mylar film is thermally laminated to the photoconductor, with the adhesive between the film and photoconductor layer. The photoreceptor thus produced is smooth and pin hole free and ready for use in the following imaging method.

The photoreceptor is charged to +1000 volts by means of a conventional corotron, and exposed to projected light and shadow pattern through the rear electrode onto the photoconductive insulating layer — exposure of approximately 1 fcs tungsten radiation (color temperature 2850° K). The latent image thus formed is manually developed by means of a "magnetic brush" formed by conductive toner of the type described in Example 1 of Shely patent (U.S. Pat. No. 3,563,734). The preferred toner used comprises 44 wt% Epon resin 1004 (Shell Chemical Co.), 52% magnetite, and 40% conductive carbon black. The toner has a mean particle size of 10 – 15 micrometers, and a conductivity of the order of $10^{-7}$ ohm-cm. The magnetic brush is supported by a grounded aluminum tube having a wall thickness of 0.005 inch, containing a bar magnet. A high contrast positive toner image of the original light and shadow pattern is produced on the Mylar surface of the photoreceptor. The toner image is now transferred to a sheet of Xerox 1024 bond paper backed by a suitably biased conductive rubber transfer roll. The plate is cleaned and re-charged to a uniform surface potential of + 1000V (using the scorotron screen to control the potential of the photoreceptor), then re-developed without re-exposure to produce a second copy of the same original projected image. Transfer, cleaning, re-charging, and re-development may be repeated at least six times without loss of useful image contrast. After the desired number of images has been drawn from the single exposure, the plate is restored to its initial un-charged state by either one of two procedures: (*a*) after the final transfer step, the plate is blanket illuminated under zero DC bias AC charging, or (*b*) after the final transfer step, the plate is subjected to blanket illumination simultaneous with wiping the surface with a methanol moistened cotton pad.

In each of the foregoing Examples, the toner laden developer electrode can be biased in the conventional manner to further enhance image contrast. The specific embodiments of the process of this invention as illustrated by the foregoing Examples can be further modified by projection of image information onto the imaging member simultaneous with sensitization of the dielectric surface of these members.

What is claimed is:

1. In an electrostatographic imaging method wherein an imaging member is sensitized by charging to the appropriate polarity, exposed to a light and shadow image pattern thereby forming a latent electrostatic image on the surface of the imaging member, and the latent image rendered visible by development with colored marking materials, the improvement comprising:

a. providing an imaging member comprising a conductive substrate, a photoconductive insulating layer and an insulating film overcoating the free surface of the photoconductive insulating layer, said insulating film being substantially incapable of supporting injection or transport of charge carriers of either polarity and substantially nonabsorbing of electromagnetic radiation within the wavelength of spectral response of the photoconductive insulating layer, the effective dielectric thickness of the insulating film relative to the photoconductive insulating layer being in the range of about 0.1:1 to about 10:1;

b. establishing an electric field between the surface of the insulating film and the conductive substrate by charging the surface of the insulating film to the appropriate polarity;

c. exposing the photoconductive insulating layer of the imaging member to a light and shadow pattern of activating electromagnetic radiation, whereupon the field in the exposed areas is collapsed across the photoconductive insulating layer and charge carriers become trapped at the interface of the insulating film and the photoconductive insulating layer in substantial correspondence to the photoactivated areas of the photoconductive insulating layer; and d. contacting the developer laden surface of a conductive electrode with the sensitized surface of the insulating film of the imaging member, whereby mobile carriers at the interface of the photoconductive insulating layer and the conductive substrate are shunted from said interface into said electrode causing selective transfer of developer from the electrode to the surface of the insulating film; and e. separating the developer laden electrode and the insulating film, whereby mobile charge carriers are shunted from said developer laden electrode back to the interface of the photoconductive insulating layer and the conductive substrate.

2. The imaging method of claim 1, wherein the biased electrode consists essentially of a gravure roller laden with polar liquid developer.

3. The imaging method of claim 1, wherein the imaging member employed in said method has a separately formed barrier layer interfaced between the conductive substrate and the photoconductive insulating layer.

4. The imaging method of claim 1, wherein the conductive electrode consists essentually of conductive toner laden electrode.

5. An electrostatographic imaging method comprising:

a. providing an imaging member comprising a conductive substrate, a photoconductive insulating layer and an insulating film overcoating the free surface of the composite photoconductive insulating layer, said insulating film being substantially incapable of supporting injection or transport of charge carriers of either polarity and substantially nonabsorbing of electromagnetic radiation with the wavelength of spectral response of the composite photoconductive insulating layer, the effective dielectric thickness of the insulating film relative to the photoconductive insulating layer being in the range of about 0.1:1 to about 10:1;

b. establishing an electric field between the surface of the insulating film and the conductive substrate by charging the surface of the insulating film to the appropriate polarity;

c. exposing the photoconductive insulating layer of the imaging member to a light and shadow pattern of activating electromagnetic radiation, whereupon the field in the exposed areas is collapsed across the photoconductive insulating layer and charge carriers become trapped at the interface of the insulating film and the photoconductive insulating layer in substantial correspondence to the photoactivated areas of the photoconductive insulating layer; and d. simultaneously forming a latent image and developing said latent image on the surface of the insulating film by contacting a conductive gravure roller laden with polar liquid developer with the sensitized surface of the dielectric film, whereby mobile carriers at the interface of the photoconductive insulating layer and the conductive substrate are shunted from said interface into the gra vure roller to the surface of the insulating film; and e. separating the developer laden electrode and the insulating film, whereby mobile charge carriers are shunted from said developer laden electrode back to the interface of the photoconductive insulating layer and the conductive substrate.

6. The imaging method of claim 5, wherein the imaging member employed in said method has a separately formed barrier layer interfaced between the conductive substrate and the photoconductive insulating layer.

7. In an electrostatographic imaging method wherein an imaging member is sensitized by charging to the appropriate polarity, exposed to a light and shadow image pattern thereby forming a latent electrostatic image on the surface of the imaging member, and the latent image rendered visible by development with colored marking materials, the improvement comprising:

a. providing an imaging member comprising a conductive substrate, a composite photoconductive insulating layer and an insulating film overcoating the free surface of the composite photoconductive insulating layer, said insulating film being substantially incapable of supporting injection or transport of charge carriers of either polarity and substantially nonabsorbing of electromagnetic radiation within the wavelength of spectral response of the photoconductive insulating layer, the effective dielectric thickness of the insulating film relative to the composite photoconductive insulating layer being in the range of about 0.1:1 to about 10:1;

said composite photoconductive insulating layer having a charge carrier generator layer and a charge carrier transport layer, the range of spectral response of the charge carrier generator layer being beyond the range of substantial spectral response of the charge carrier transport layer and the ratio of thickness of the photogenerator layer to the transport layer being in the range of from about 1:200 to about 1:1;

b. establishing an electric field between the surface of the insulating film and the conductive substrate by charging the surface of the insulating film to the appropriate polarity, said polarity being determined by the arrangement of the charge carrier generator layer and the transport layer in the composite photoconductive insulating layer relative to the insulating film;

c. exposing the charge carrier generator layer of the imaging member to a light and shadow pattern of activating electromagnetic radiation, whereupon the field in the exposed areas is collapsed across the composite photoconductive insulating layer and charge carriers become trapped at the interface of the dielectric film and the composite photoconductive insulating layer in substantial correspondence to the photoactivated areas of the photo-generator layer; and d. contacting the developer laden surface of a conductive electrode with the sensitized surface of the insulating film of the imaging member, whereby mobile carriers at the interface of the composite photoconductive insulating layer and the conductive substrate are shunted from said interface into said electrode causing selective transfer of developer from the electrode to the surface of the insulating film; and e. separating the developer laden electrode and the insulating film, whereby mobile charge carriers are shunted from developer laden electrode back to the interface of the photoconductive insulating layer and the conductive substrate.

8. The imaging method of claim 7, wherein the biased electrode consists essentially of a gravure roller laden with polar liquid developer.

9. The imaging method of claim 7, wherein the composite photoconductive insulating layer consists essentially of a charge carrier generator layer comprising amorphous selenium and a charge carrier transport layer capable of rapid and efficient transport of only one species of charge carrier.

10. The imaging method of claim 7, wherein the charge carrier transport layer of the composite photoconductive insulating layer is capable of rapid and efficient transport of holes.

11. The imaging method of claim 7, wherein the charge carrier transport layer of the composite photoconductive insulating layer is capable of rapid and efficient transport of electrons.

12. The imaging method of claim 7, wherein the charge carrier generator layer of the composite photoconductive insulating layer is contiguous with the insulating film.

13. The imaging method of claim 7, wherein the charge carrier transport layer of the composite photoconductive insulating layer is contiguous with the insulating film.

14. The imaging method of claim 7, wherein the imaging member employed in said method has a separately formed barrier layer interfaced between the conductive substrate and the composite photoconductive insulating layer.

15. The imaging method of claim 7, wherein the imaging member employed in said method is devoid of a separately formed barrier layer interfaced between the photoconductive composite and the conductive substrate and the charge carrier transport of said composite photoconductive insulating layer is contiguous with said conductive substrate.

16. An electrostatographic imaging method comprising:

a. providing an imaging member comprising a conductive substrate, a composite photoconductive insulating layer and an insulating film overcoating thre free surface of the composite photoconductive insulating layer, said insulating film being substantially incapable of supporting injection or transport of charge carriers of either polarity and substantially nonabsorbing of electromagnetic radiation with the wavelength of spectral response of the composite photoconductive insulating layer, the effective dielectric thickness of the insulating film relative to the composite photoconductive insulating layer being in the range of about 0.1:1 to about 10:1;

said composite photoconductive insulating layer having a charge carrier generator layer and a charge carrier transport layer, the range of spectral response of the charge carrier generator layer being beyond the range of substantial spectral response of the charge carrier transport layer and the ratio of thickness of the charge carrier generator layer to transport layer being in the range of about 1:200 to about 1:1;

b. establishing an electric field between the surface of the insulating film and the conductive substrate by charging the surface of the insulating film to the appropriate polarity, said polarity being determined by the arrangement of the charge carrier generator layer and the transport layer in the composite photoconductive insulating layer relative to the insulating film;

c. exposing the charge carrier generator layer of the imaging member to a light and shadow pattern of activating electromagnetic radiations, whereupon the field in the exposed areas is collapsed across the composite photoconductive insulating layer and charge carriers become trapped at the interface of the insulating film and the composite photoconductive insulating layer in substantial correspondence to the photoactivated areas of the charge carrier generator layer; and d. simultaneously forming a latent image and developing said latent image on the surface of the insulating film by contacting a conductive gravure roller laden with polar liquid developer with the sensitized surface of the dielectric film, whereby mobile carriers at the interface of the composite photoconductive insulating layer and the conductive substrate are shunted from said interface into the gravure roller causing selective transfer of polar ink from the gravure roller to the surface of the insulating film; and e. separating the electrode and the insulating film.

17. The imaging method of claim 16, wherein the composite photoconductive insulating layer consists essentially of a charge carrier generator layer comprising amorphous selenium and a charge carrier transport layer capable of rapid and efficient transport of only one species of charge carrier.

18. The imaging method of claim 16, wherein the charge carrier transport layer of the composite photoconductive insulating layer is capable of rapid and efficient transport of holes.

19. The imaging method of claim 16, wherein the charge carrier transport layer of the composite photoconductive insulating layer is capable of rapid and efficient transport of electrons.

20. The imaging method of claim 16, wherein the charge carrier generator layer of the composite photoconductive insulating layer is contiguous with the insulating film.

21. The imaging method of claim 16, wherein the charge carrier transport layer of the composite photoconductive insulating layer is contiguous with the insulating film.

22. The imaging method of claim 16, wherein the imaging member employed in said method has a separately formed barrier layer interfaced between the conductive substrate and the composite photoconductive insulating layer.

23. The imaging method of claim 16, wherein the imaging member employed in said method is devoid of a separately formed barrier layer interfaced between the photoconductive composite and the conductive substrate and the charge carrier transport of said composite photoconductive insulating layer is contiguous with said conductive substrate.

24. An electrophotographic imaging member comprising a conductive substrate, a composite photoconductive insulating layer and an insulating film overcoating the free surface of the composite photoconductive insulating layer, said insulating film being substantially incapable of supporting injection or transport of charge carriers of either polarity and substantially nonabsorbing of electromagnetic radiation within the wavelength of spectral response of the composite photoconductive insulating layer, the effective dielectric thickness of the insulating film relative to the composite photoconductive insulating layer being in the range of about 0.1:1 to about 10:1, said composite photoconductive insulating layer having a charge carrier generator layer and a charge carrier transport layer, the range of spectral response of the charge carrier generator layer being beyond the range of substantial spectral response of the charge carrier transport layer and the ratio of thickness of the photogenerator layer to the transport layer being in the range of from about 1:200 to about 1:1.

25. The imaging method of claim 1 wherein the effective dielectric thickness of the insulating film relative to the photoconductive insulating layer is in the range of from about 0.5:1 to about 2:1.

26. The imaging method of claim 5 wherein the effective dielectric thickness of the insulating film relative to the photoconductive insulating layer is in the range of from about 0.5:1 to about 2:1.

27. The imaging method of claim 7 wherein the effective dielectric thickness of the insulating film relative to the composite photoconductive insulating layer is in the range of from about 0.5:1 to about 2:1.

28. The imaging method of claim 16 wherein the effective dielectric thickness of the insulating film relative to the composite photoconductive insulating layer is in the range of from about 0.5:1 to about 2:1.

29. The electrophotographic imaging member of claim 24 wherein the effective dielectric thickness of the insulating film relative to the composite photoconductive insulating layer is the range of from about 0.5:1 to about 2:1.

* * * * *